United States Patent [19]

Murakami

[11] 4,410,167

[45] Oct. 18, 1983

[54] METHOD OF APPLYING A REFRACTORY LINING TO A ROTARY STEEL CONVERTER

[75] Inventor: Keikichi Murakami, Kobe, Japan

[73] Assignee: Kawasaki Jukogyo K.K., Kobe, Japan

[21] Appl. No.: 278,008

[22] Filed: Jun. 25, 1981

Related U.S. Application Data

[62] Division of Ser. No. 103,619, Dec. 14, 1979, abandoned.

[30] Foreign Application Priority Data

Dec. 22, 1978 [JP] Japan ..... 53-163691

[51] Int. Cl.[3] ..... C21B 7/04

[52] U.S. Cl. ..... 266/281; 75/52; 75/60; 75/91

[58] Field of Search ..... 266/281; 75/95, 60, 75/52

[56] References Cited

U.S. PATENT DOCUMENTS 2,930,688 3/1960 Kalling ..... 75/52

4,270,949 6/1981 Esposito ..... 75/95

*Primary Examiner*—P. D. Rosenberg

*Attorney, Agent, or Firm*—Martin Smolowitz

[57] ABSTRACT

A converter vessel is coaxially surrounded by a trunnion ring carried by a pair of trunnions for rotary or tilting motion about a horizontal axis. In order to permit rotation of the vessel relative to the trunnion ring about the vessel axis at right angles with the noted horizontal axis, two annular rows of support elements such as rollers are mounted on the trunnion ring and engaged with respective annular tires on the vessel so as to bear its radial load. Two other annular rows of rollers or like support elements are also mounted on the trunnion ring and engaged with the respective tires so as to bear the axial vessel load. Several identical drive mechanisms are compactly mounted within the trunnion ring for revolving the vessel through a gear drive, friction drive, or chain drive.

9 Claims, 20 Drawing Figures

METHOD OF APPLYING A REFRACTORY LINING TO A ROTARY STEEL CONVERTER

This is a division of application Ser. No. 103,619 filed Dec. 14, 1979 now abandoned.

BACKGROUND OF THE INVENTION

1. Field of the Invention

This invention pertains to steelmaking converters, and in particular to a rotary converter having a vessel which is not only tiltable on trunnions but also rotatable about its own axis at right angles with the trunnion axis. The invention relates also to methods of making steel by using the converter and to methods of applying refractory linings to the inner surface of the converter.

2. Description of the Prior Art

Among well-known steel converters are the top-blown pure-oxygen converter, the bottom- and side-blown converters, the Kaldo converter, and the rotor converter. Of these the top-blown pure-oxygen converter known also as the Linnz and Donnewits (L-D) converter or the basic oxygen furnace (BOF) converter, has won perhaps the most extensive acceptance among steelmakers the world over. This greater popularity of the L-D or BOF converter comes from its lower installation cost, higher productivity, and superior quality of the steel produced.

The L-D converter has its own drawbacks, however. One of these is the rapid consumption of the refractory lining, although this is a problem common to all steelmaking furnaces. Another is its low desulfurizing and dephosphorizing capabilities. Intensive efforts are under way in various quarters to overcome these problems, and two measures have already been suggested to make up for refractory consumption.

The first is the spraying of powdered refractories. The second calls for a refining operation with the use of a high magnesia-content slag, formed by addition of lightburned or raw dolomite or the like, and the subsequent coating of that slag on the worn refractory lining. These and similar conventional measures are subject to the following objections.

1. The converter vessel may become untiltable because of undue slag accumulation on its bottom refractory.

2. The steel shell of the vessel may be overheated, and so deformed or even molten, owing to the uneven wear of the refractory lining, especially at the side of the vessel, and to its improper repair.

3. The refractory lining may strip off the shell under the weight of the slag adhering thereto.

4. Excessive slag attachment to the vessel lining may decrease the actual vessel capacity, resulting in increased slopping.

5. Excessive slag attachment to the bottom lining of the vessel may affect the level of the bath.

6. The converter must be operated with utmost care against the danger accruing from the above five possible causes, either individually or in combinations of two or more.

7. Steel production may decrease by reason of extended downtime due to frequent repairs of the refractory lining.

8. Skilled repairmen, required to work under excessive heat, must be on a full-time service.

9. No substantial saving is realized in the amounts of the refractory materials used, including those necessary for repairs such as lightburned or raw dolomite and powdered refractories.

Thus, while the conventional measures have certainly achieved a remarkable extension of the life of refractory linings, they can hardly be acclaimed as fundamental remedies for refractory consumption because of the above enumerated objections.

Some problems encountered in the practice of the conventional refractory repair measures will not be considered. These known measures work well for refractory consumption in certain localized regions of the vessel lining. The foregoing objections arise because the high magnesia-content slag cannot possibly be coated, or the powdered refractories cannot be efficiently sprayed, on the other lining regions.

The obvious reason for this is that the vessel can be tiled 360 degrees only about the axis of the trunnions at right angles with the vessel axis. Since the vessel is substantially cylindrical in shape, and since the vessel is tilted in one and the same plane, the molten metal and slag therein contact only the limited areas of the refractory lining. Only such limited lining areas can therefore be repaired by the conventional slag-coating method, inviting uneven consumption of the lining. The powdered refractories cannot also be effectively sprayed on some lining areas of particular angular dispositions.

The only practical solution to these difficulties is to make the vessel rotatable about its own axis, besides being tiltable about the trunnion axis. Two rotary converters have already been suggested and used, namely, the Kaldo converter and the rotor converter. Both of these known rotary converters rotate about inclined, nearly horizontal axes to afford the intermixing of molten metal and slag with a view to better desulfurization and dephosphorization. The construction of the Kaldo converter (shown in FIGS. 1 and 2 of the accompanying drawings) will be later explained in some detail, and its structural problems pointed out.

What follows is a list of engineering factors that merit due consideration in designing and constructing such rotary converters.

1. The total weight of the vessel and associated parts to be revolved is as much as from several hundred to more than 1000 tons.

2. The vessel and its support structures are subjected to temperatures ranging from room temperature to 400° C. and, in some instances, as high as 700° C. or more.

3. The direction of the load which the vessel exerts on the trunnion ring varies 360° about the trunnion axis.

4. The entire converter equipment must operate properly under the most severe conditions, with exposure to high-temperature molten slag, combustion gases, metal splashes, and iron oxide dust.

5. Utmost constructional and operational safety is required since the converters are to handle molten metal at temperatures well over 1,600° C.

In addition to all these considerations, rotary converters, if they are to gain true practical utility, should be simple, rugged, and maintenance-free in construction and compact in size.

SUMMARY OF THE INVENTION

The present invention provides, in summary, an improved rotary steel converter comprising a vessel having a first axis, a trunnion ring coaxially encircling the vessel, and means for supporting the trunnion ring for rotary or tilting motion about a second axis oriented normal to the first axis. For revolving the vessel about the first axis relative to the trunnion ring, the improved converter further comprises a multiplicity of radial support elements mounted in annular configuration on the trunnion ring and bearing the radial load of the vessel so as to permit rotation thereof, a multiplicity of axial support elements also mounted in annular configuration on the trunnion ring and bearing the axial load of the vessel so as to permit rotation thereof, and drive means for imparting rotation to the vessel.

In a preferred embodiment both of the radial and the axial support elements take the form of rollers. The radial rollers are rotatably mounted on the trunnion ring in two annular rows for rolling engagement with respective annular tires formed on the vessel. The axial, or thrust, rollers are likewise rotatably mounted on the trunnion ring in two annular rows for rolling engagement with the respective tires. The drive means, preferably comprising several identical drive mechanisms, is compactly mounted within the trunnion ring, driving the vessel either positively or frictionally.

With the radial and axial loads of the vessel borne by the large number of rollers as described above, the size of each roller can be reduced to a minimum. Consequently, regardless of their numbers, the radial and thrust rollers can be compactly mounted on the trunnion ring, without substantially increasing the overall size of the converter.

This invention also provides a method of making steel by using the rotary converter. The rotation of the vessel about the first axis during refining operation, with or without tilting or oscillating motion about the second axis, enables proper agitation and intermixing of the molten pig iron, scrap, and admixtures contained therein. Oxygen or other gas blown into the vessel also makes intimate contact with these materials. This results in higher desulfurizing and dephosphorizing performance and greater productivity of the converter.

This invention also provides a method of applying the refractory lining to the inner surface of the vessel of the converter. The rotary and tilting motions of the vessel about the two orthogonal axes also enable the application of the known refractory repair methods to better advantage, as will be later explained. All of the parts of the refractory lining of the improved converter can be maintained in good repair, without involving much labor or cost. This also means that the initial thickness of the refractory lining can be of an absolute minimum required for heat insulation, so that the converter size can be correspondingly reduced for a given charge capacity.

Further features and advantages of the invention will appear from the following description of some preferable embodiments thereof, given by way of example only, with reference had to the accompanying drawings.

DETAILED DESCRIPTION OF THE INVENTION

Figure 1:
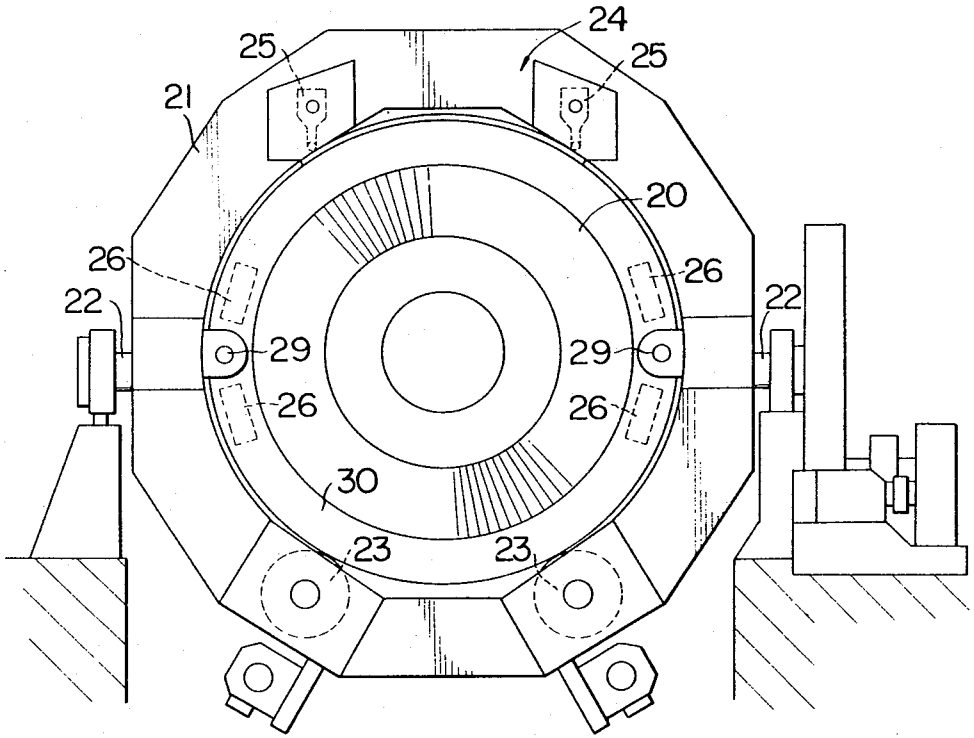
FIG. 1 PRIOR ART
FIG. 1 is an elevational view of the known Kaldo converter.
Figure 2:
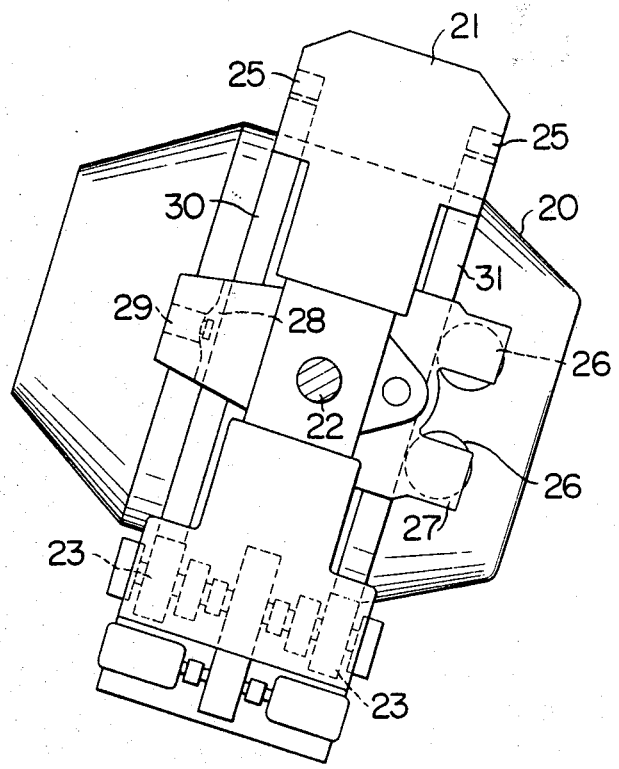
FIG.2 PRIOR ART
FIG. 2 is a right side elevational view of the Kaldo converter of FIG. 1.

The conventional Kaldo converter will first be briefly described with reference to FIGS. 1 and 2, the better to make clear the features and advantages of the present invention. The illustrated Kaldo converter has a vessel 20 rotatably supported by an encircling trunnion ring 21 mounted on a pair of trunnions 22. The trunnion ring 21 bears the radial load of the vessel 20 via four radial rollers 23 and a clamp band mechanism 24 actuated by hydraulic cylinders 25. Further, for bearing the axial thrust of the vessel 20, the trunnion ring 21 has four thrust rollers 26, mounted on balance beams 27, and a pair of stop mechanisms 28 actuated by respective hydraulic cylinders 29. The radial and thrust rollers 23 and 26 are in rolling engagement with annular tires 30 and 31 wrapped around the vessel 20.

The above outlined construction of the Kaldo converter has the following drawbacks.

1. The vessel 20 is rotatable about its own axis while being tilted only in a limited range of angles at which the vessel can be properly supported by the radial and thrust rollers 23 and 26.

2. Being heavily loaded, the radial and thrust rollers must be of inconveniently large diameters. Such large-diameter rollers necessitate the use of a trunnion ring 21 of correspondingly large size, thus increasing the installation space of the converter.

3. The unavoidable elastic or plastic deformation, due to heat and/or stress, and the consequent dimensional changes of the support and drive mechanisms are countered merely by increasing the sizes of the individual parts. Such parts are easily overloaded and fractured. Actually, through uneven contact between rollers 23 and 26 and tires 30 and 31, such troubles as their rapid wear, detachment, and fracture have occurred.

4. The installation cost of the Kaldo converter is therefore higher than that of the L-D converter, and the cost including labor cost required for its maintenance is high.

The improved rotary steel converter in accordance with the present invention overcomes all these and other problems of the prior art pointed out hereinbefore. With reference first to FIGS. 3, 4, 5 and 6 the invention is therein shown adapted for a top-blown pure-oxygen converter. The example converter comprises an open-top, solid-bottom vessel 32, including a shell 33 and a refractory lining 34, and a trunnion ring 35 coaxially surrounding and rotatably supporting the vessel 32 and itself rotatably or tiltably supported by a pair of trunnions 36.

Figure 3:
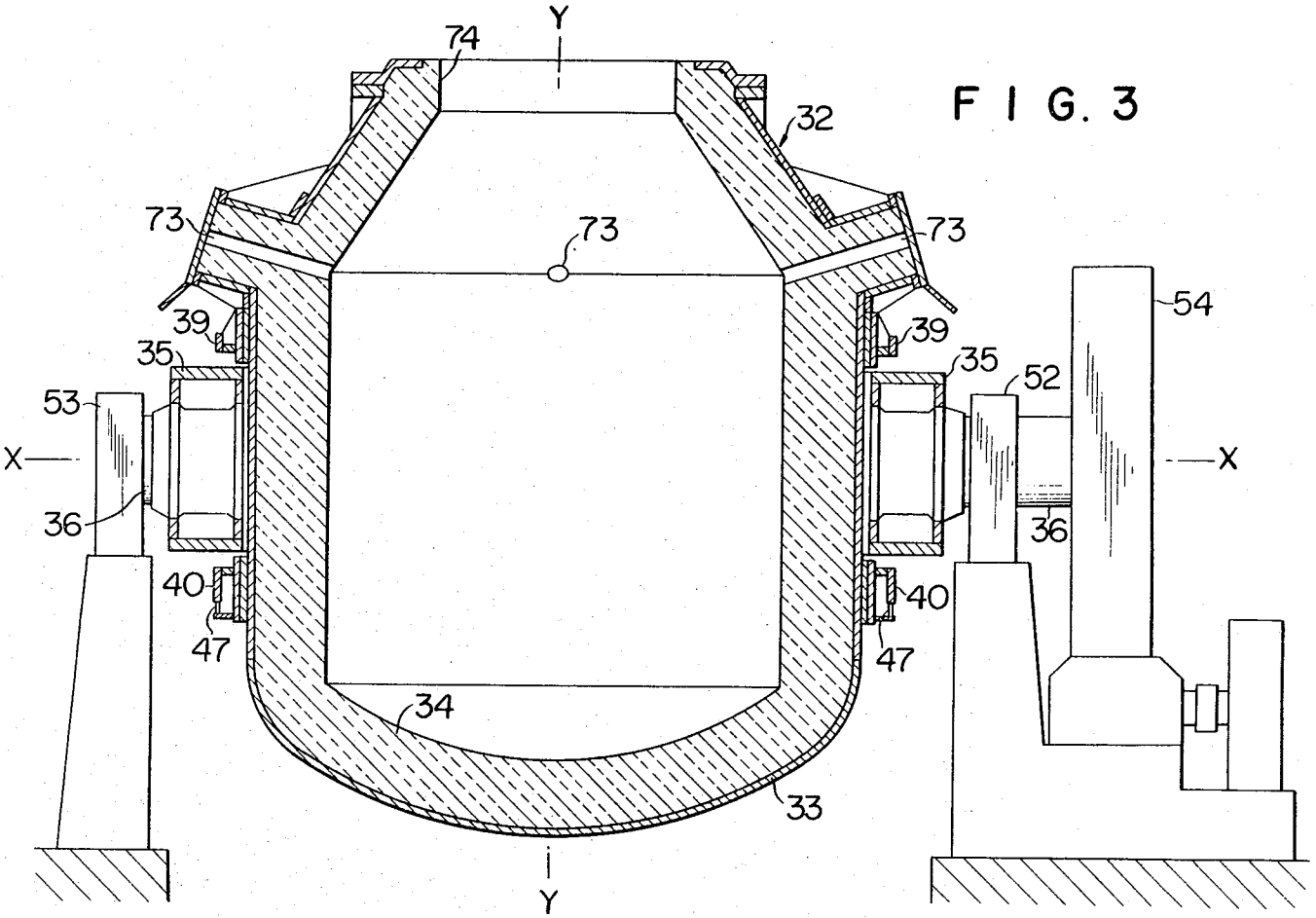
FIG. 3 is an axial sectional view, with some parts shown in elevation, of one preferred embodiment of this invention as adapted for a top-blown pure-oxygen converter.
Figure 4:
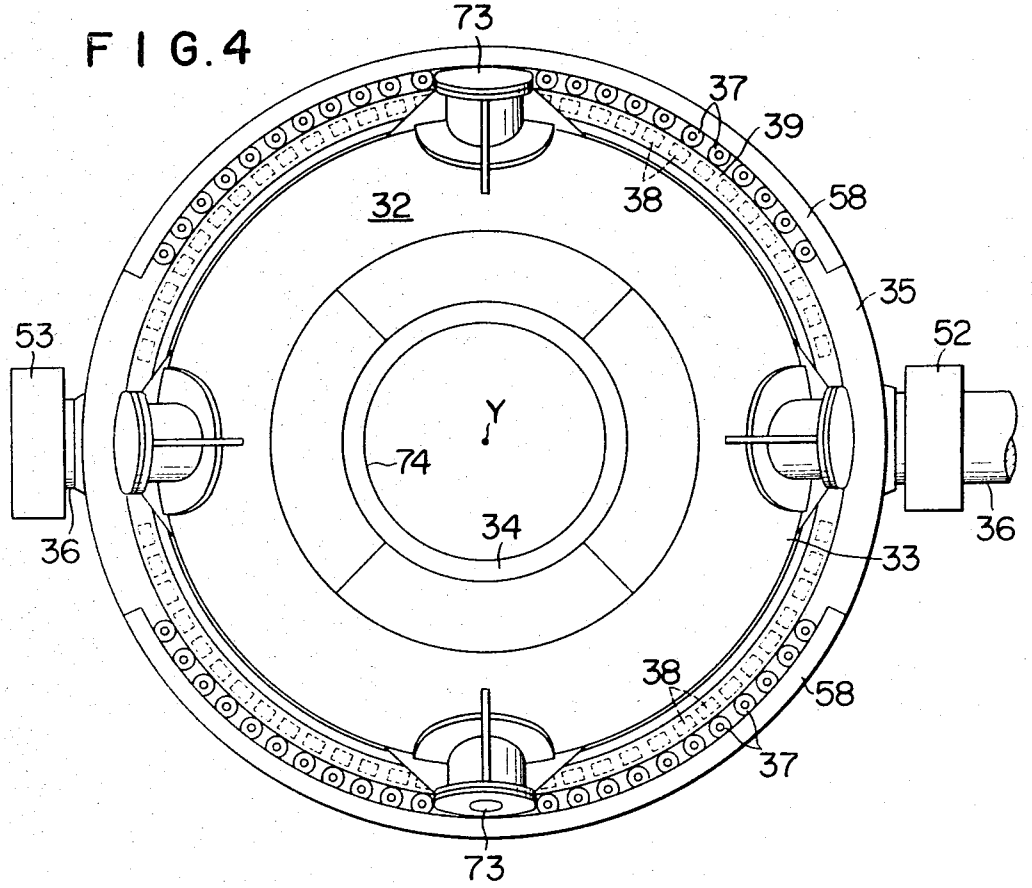
FIG. 4 is a top plan view of the rotary converter of FIG. 3.
Figure 5:
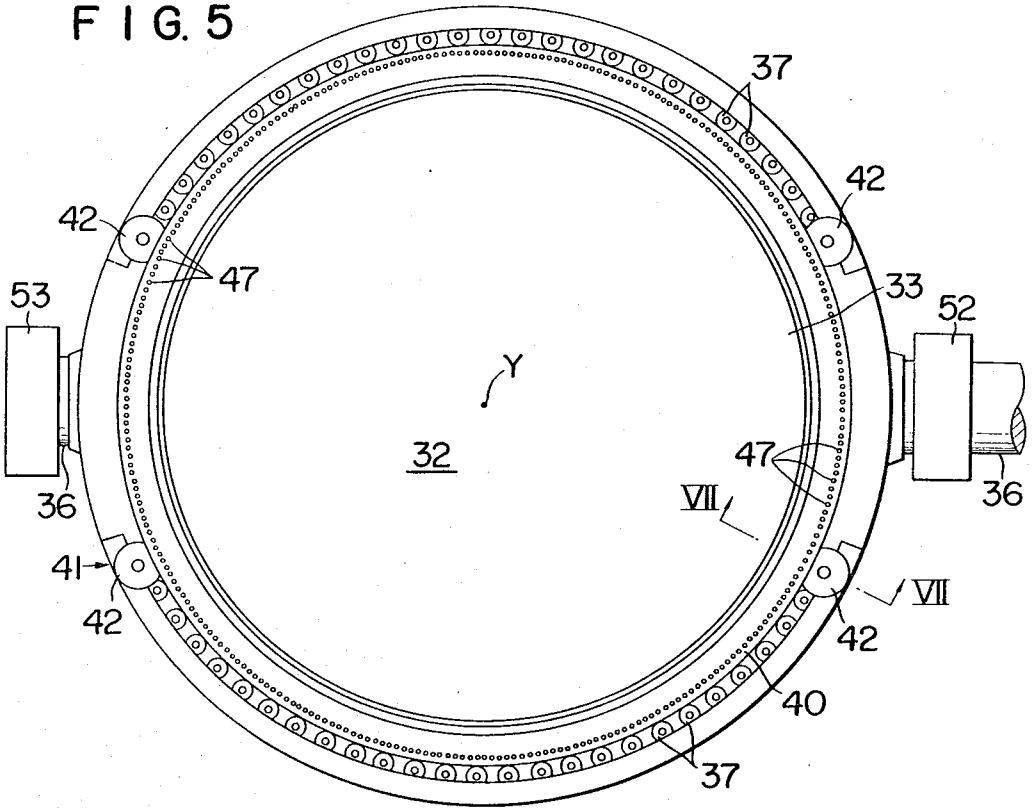
FIG. 5 is a bottom plan view of the rotary converter of FIG. 3.

The line Y—Y in FIG. 3 indicates the longitudinal axis of the vessel 32 (hereinafter referred to as the vessel axis) about which the vessel is rotatable relative to the trunnion ring 35. The line X—X denotes the axis of the trunnions 36 (hereinafter referred to as the trunnion axis) which is oriented at right angles with the vessel axis Y—Y and about which the vessel 32 is tiltable with the trunnion ring 35. The vessel 32 is axially symmetrical with respect to the vessel axis Y—Y.

Figure 6:
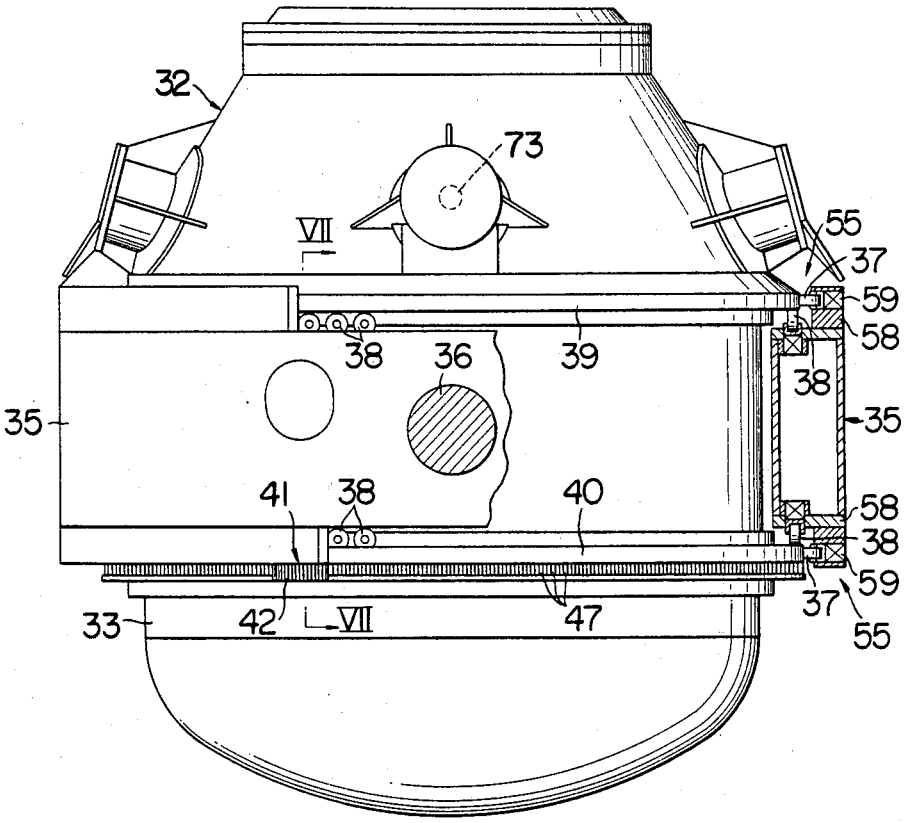
FIG. 6 is a side elevational view, partly broken away and partly sectioned for clarity, of the rotary converter of FIG. 3.

For rotatably supporting the vessel 32 against its radial and axial loading, the trunnion ring 35 has rotatably mounted thereon two parallel, annular rows of radial rollers 37 and two parallel, annular rows of thrust rollers 38, as best seen in FIG. 6. The two radial roller rows 37 and the two thrust roller rows 38 ar both spaced apart in the axial direction of the vessel 32. The radial rollers 37 individually rotate about axes parallel to the vessel axis Y—Y, whereas the thrust rollers 38 individually rotate about axes at right angles to the vessel axis Y—Y.

Rigidly encircling the vessel 32 are two (upper and lower) parallel, annular tires 39 and 40 spaced apart in the axial direction of the vessel and being in relative rolling engagment with the radial rollers 37 and thrust rollers 38. The tires 39 and 40 make circumferential contact with the respective rows of the radial rollers 37. When the vessel 32 is in the upright position shown in FIGS. 3 and 6, the upper row of the thrust rollers 38 contact the upper tire 39 from therebelow, and the lower row of the thrust rollers 38 contact the lower tire 40 from thereabove.

The rotation of the vessel 32 relative to the trunnion ring 35 is accomplished by a plurality of (four in this embodiment of the invention) drive mechanisms 41 mounted within the trunnion ring 35 and each including a drive gear 42. It is to be noted, however, that only one such drive mechanism could be employed without departing from the scope of this invention. Since the illustrated four drive mechanisms 41 are identical in construction, only one of them is shown in detail in FIG. 7. The following description of this figure applies, of course, to any of the other three drive mechanisms.

Figure 7:
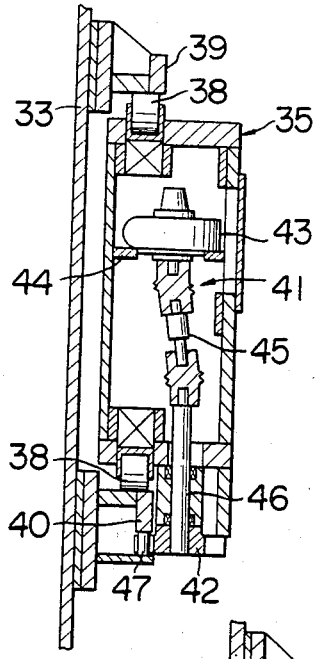
FIG. 7 is a fragmentary sectional view taken along the line VII—VII of FIGS. 5 and 6 and showing in detail one of the four identical drive mechanisms in the rotary converter of FIG. 3.

The representative drive mechanism 41 of FIG. 7 includes a drive source 43 (still to be described) mounted on a shelf 44 within the trunnion ring 35. The drive source 43 has its output shaft connected via a coupling 45 to a drive shaft 46 oriented parallel to the vessel axis Y—Y. Fixedly mounted on this drive shaft 46 is the above noted drive gear 42 meshing with a series of driven gear teeth arranged annularly and coaxially on the vessel 32. In this particular embodiment the driven gear teeth take the form of the individual pins 47 of a pinwheel.

The drive source 43 of each drive mechanism 41 may be either a hydraulic or an electric motor. The illustrated embodiment of the invention employs a hydraulic motor because of the desired compactness of the overall converter equipment.

Figure 8:
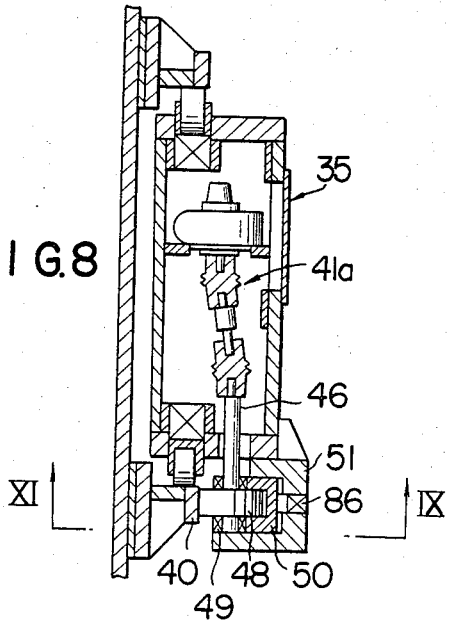
FIG. 8 is a view similar to FIG. 7 but showing an alternative form of the drive mechanism.
Figure 9:
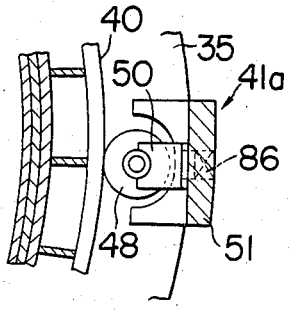
FIG. 9 is a sectional view taken along the line IX—IX of FIG. 8.

Instead of the gear drive employed by the drive mechanism 41 of FIG. 7, a friction drive may be adopted as in a modified drive mechanism **41*a* shown in FIGS. 8 and 9. This alternative drive mechanism 41*a* has a drive roll 48 mounted on the drive shaft 46 and making frictional contact with the lower tire 40 of the vessel 32. Preferably the drive roll 48 is rotatably supported via a bearing 49 by a yoke 50 slidably received in a guide 51 for movment toward and away from the lower tire 40. Resilient means such as a spring is supported at 86 by the guide 51 for biasing the drive roll 48 against the lower tire 40**.

A chain drive is another possible alternative to the drive mechanism 41. Although not specifically illustrated, the chain drive may comprise a sprocket wheel mounted on the drive shaft 46, and an endless chain wrapped around the vessel 32 for engagement with the sprocket wheel.

With reference back to FIGS. 3 through 6, the vessel 32 can therefore be rotated about its own axis Y—Y relative to the trunnion ring 35 as the hydraulic motors 43 of the four drive mechanisms 41 or **41*a* are set in rotation in a predetermined direction. FIG. 3 further shows that the pair of trunnions 36 projecting radially from the trunnion ring 35 are rotatably journaled in respective bearings 52 and 53. A suitable tilting mechanism such as the conventional pin gear arrangement in mounted at 54 and coupled to the trunnion 36. Thus the vessel 32 is both revolved about its own axis Y—Y by the drive mechanisms 41 or 41*a* and tilted or oscillated about the trunnion axis X—X by the tilting mechanism 54**.

Figure 10:
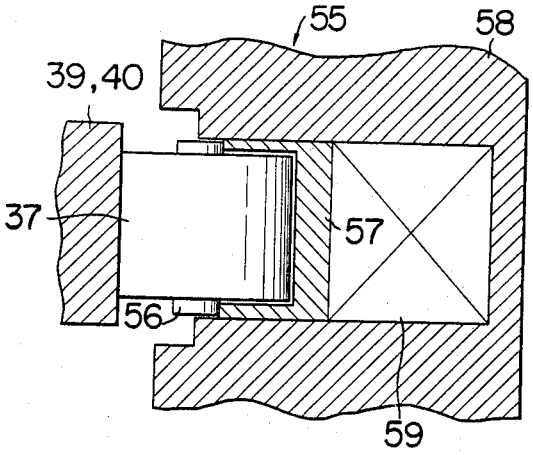
FIG. 10 is an enlarged, fragmentary, vertical sectional view of one of the roller support mechanisms in the rotary converter of FIG. 3.

The radial rollers 37 arranged in two annular rows, and the thrust rollers 38 arranged in two annular rows, are independently supported by respective roller support mechanisms on the trunnion ring 35. FIG. 10 shows on an enlarged scale the roller support mechanism 55 for each of the radial rollers 37. The support mechanism for each thrust roller 38 is essentially identical with the radial roller support mechanism 55, and its construction will be self-evident from the following description of the radial roller support mechanism 55 and from a consideration of FIG. 6.

The representative radial roller support mechanism 55 of FIG. 10 includes a spindle 56 on which each radial roller 137 is rotatably mounted via a bearing or bearings (yet to be described). The spindle 56 is supported at its opposite ends by a yoke 57. This yoke is slidably supported by a guide structure 58 of annular configuration and is thereby constrained to movement toward and away from the tire 39 or 40 in the radial direction of the vessel 32. The annular guide structure 58 is secured to the trunnion ring 35 and is common to all support mechanisms 55 for each row of radial rollers 37. Resilient means 59 (yet to be described) on the guide structure 58 biases the radial roller 37 against the tire 39 or 40 via the yoke 57.

Figure 11:
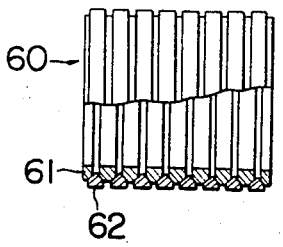
FIG. 11 is an elevational view, partly broken away and sectioned for clarity, of a ring spring for use in the roller support mechanism of FIG. 10.
Figure 12:
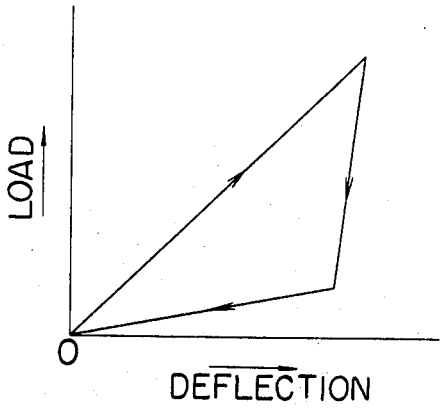
FIG. 12 is a graphic representation of the load-versus-deflection characteristic of the ring spring of FIG. 11.

While the resilient means 59 of each radial (and thrust) roller support mechanism 55 can take the forms of various types of springs and other devices, one recommended example is a so-called ring spring 60 (FIG. 11) because of its high load-bearing ability, compactness, and other properties. The ring spring 60 comprises two helical spring elements 61 and 62 nested one within the other and frictionally engaged with each other. FIG. 12 is a graph plotting the load-versus-deflection characteristic of this ring spring.

Figure 13:
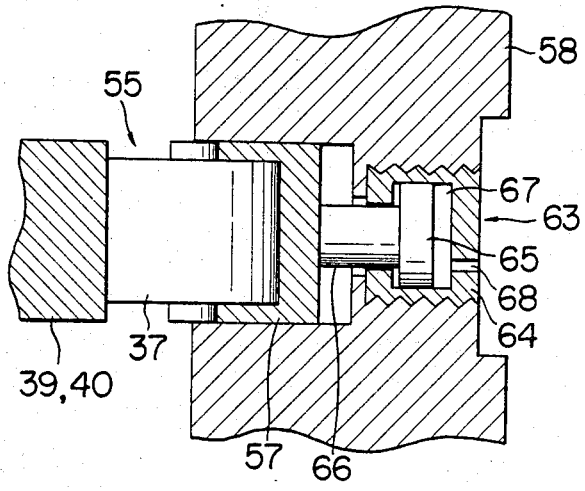
FIG. 13 is a view similar to FIG. 10 except that a hydraulic cylinder is used as the resilient means in the roller support mechanism.

Another recommended eample of the resilient means 59 is a fluid-actuated, preferably hydraulic, single-acting cylinder 63 shown in FIG. 13. The hydraulic cylinder 63 comprises a housing 64 screw-threadedly engaged in the annular guide structure 58, a piston 65 slidably fitted in the housing 64, and a piston rod 66 connecting the piston to the yoke 57 rotatably supporting each radial roller 37 (or thrust roller 38). The fluid chamber 57 of the hydraulic cylinder 63 communicates via a fluid inlet-outlet port 68 with a hydraulic control circuit (not shown) which controls the pressure acting on the piston 65.

According to one preferred mode of operation of the radial and thrust roll support mechanisms employing the hydraulic cylinders 63, a vessel angle sensor (not shown) included in the hydraulic control circuit senses the angle at which the vessel 21 is tilted about the trunnion axis X—X. The angle sensor correspondingly controls, via suitable valving, the hydraulic pressures acting on the pistons 65 of the cylinders 63. The cylinder pressures are of course so controlled that the cylinders loaded by the vessel 32 to a greater extent will receive correspondingly greater pressures.

Figure 14:
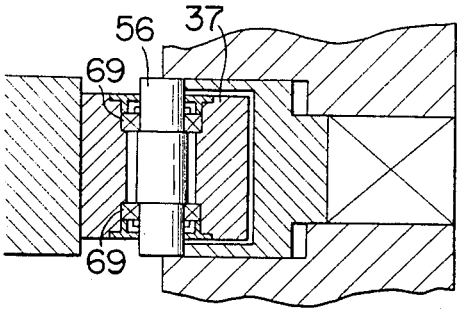
FIG. 14 is also a view similar to FIG. 10 except that here are shown two bearings through which the roller is rotatably mounted on the spindle.
Figure 15:
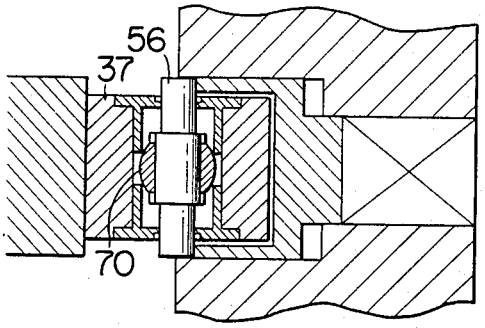
FIG. 15 is also a view similar to FIG. 10 except that here is shown a single spherical bearing through which the roller is rotatably mounted on the spindle.

FIG. 14 shows that each radial (or thrust) roller 37 is mounted on the spindle 56 via two bearings 69, with the opposite ends of the spindle journaled in these bearings. Alternatively, as shown in FIG. 15, there may be employed a single spherical or barrel-shaped bearing 70, which is mounted intermediate the opposite ends of the spindle 56. This bearing 70 is preferred because it can rotatably support the roller 37 even when the roller axis is inclined.

Such being the preferable constructions of the radial (and thrust) roller support mechanisms 55, it will be seen that the vessel 32 is resiliently supported by the multiplicity of radial 37 and thrust 38 rollers. These rollers 37 and 38 are themselves individually resiliently mounted on the trunnion ring 35. Thus, in the event of thermal expansion of the vessel 32, trunnion ring 35, and tires 39 and 40, the rollers 37 and 38 yield and conform to the deformations of such parts, maintaining proper rolling contact with the tires.

The manner in which the weight of the vessel 32 is borne by the large number of radial and thrust rollers 37 and 38 as described above provides the additional advantage of substantial reduction in the size of the converter. Since the individual rollers 37 and 38 can be of minimum size, they can be compactly mounted on the trunnion ring 35, no matter how many of them are employed.

Figure 16:
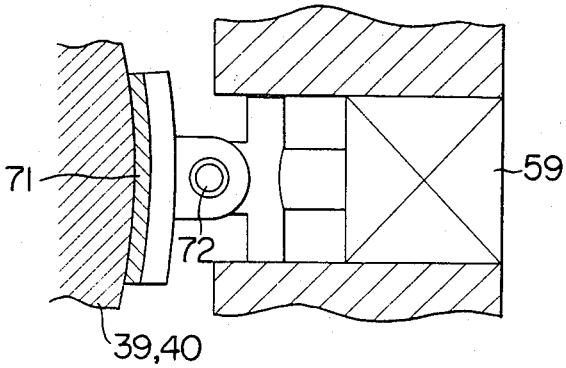
FIG. 16 is view corresponding to FIG. 10 and showing in particular a plain bearing slidably supporting the converter vessel of FIG. 3 instead of the roller.

In FIG. 16 each radial roller 37 (and thrust roller 38) is replaced by a plain bearing 71 pivotally jointed at 72 to the resilient means 59 and making sliding contact with the tire 39 or 40. Either a spring, fluid-actuated cylinder, or other devices may be used as the resilient means 59. Since the plain bearings 71 offer far more frictional resistance to the tires 39 and 40 than do the rollers 37 and 38, however, the plain bearings may be employed only in the case where the combined output torque of the drive sources 43 of the four drive mechanisms 41 is sufficiently high to rotate the vessel 32 in spite of such frictional resistance imparted to the tires 39 and 40.

Reference is again directed back to FIGS. 3, 4 and 6 to describe an additional feature of this invention. The additional feature resides in a plurality of (four in the illustrated example) discharge ports 73 formed adjacent the charge mouth 74 of the vessel 32 at constant circumferential spacings. All but one of these discharge ports are to be closed as by blind lids, plugs, or gates. The remaining one discharge port may first be put to use. When this discharge port becomes unusable because of, for example, the consumption of the refractory lining in the vicinity of that port, then any of the other three ports may be used, with the vessel 32 revolved about its own axis Y—Y to the required angular position.

Figure 17:
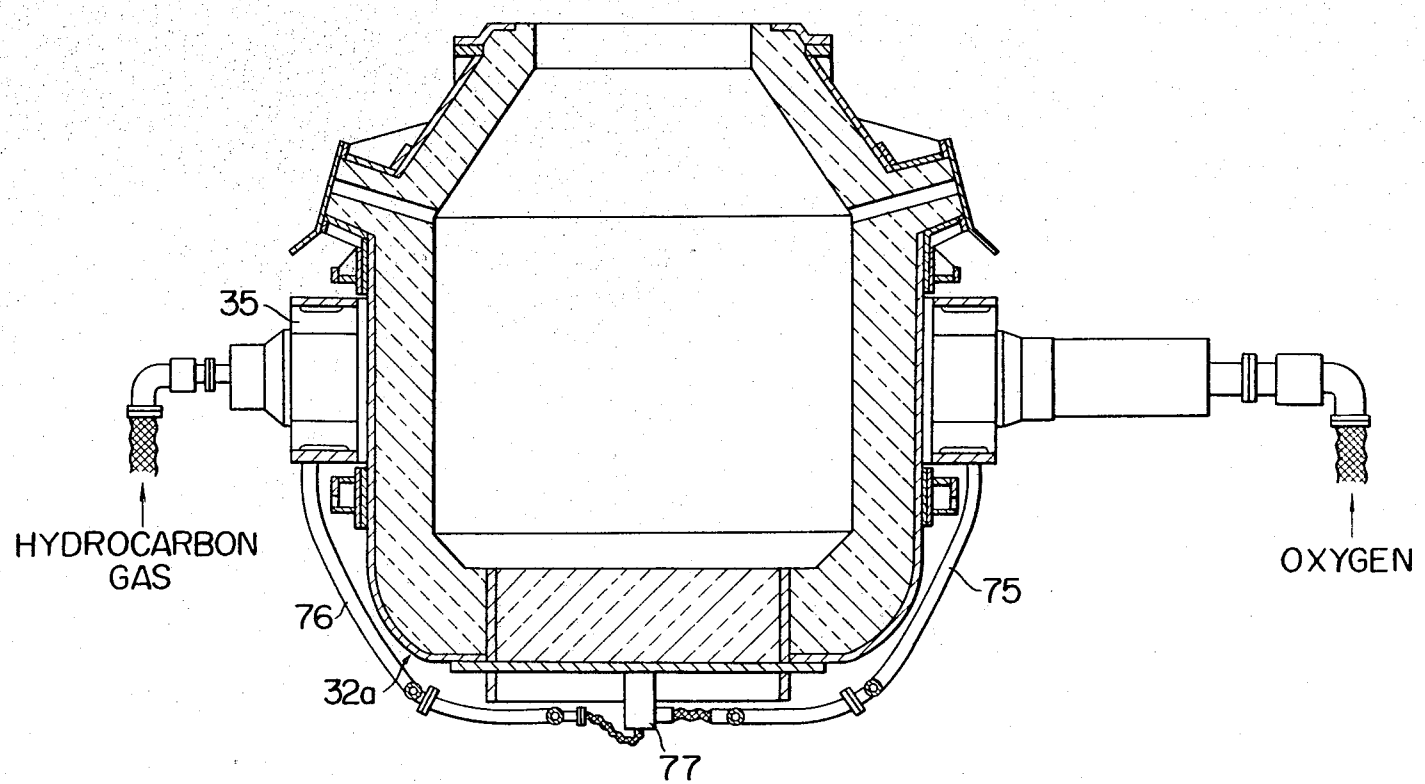
FIG. 17 is an axial sectional view of a bottom-blown converter embodying the invention.

The inventive concepts are applicable not only to top-blown converters, as in the foregoing, but also to bottom-blown ones. FIG. 17 illustrates an example of such bottom-blown converters embodying the teachings of this invention. The illustrated bottom-blown converter has two conduits 75 and 76 depending from the trunnion ring 35 and coupled to the bottom of a converter vessel **32*a* via a rotary joint 77. Gases such as oxygen and a gaseous hydrocarbon are delivered through these conduits 75 and 76 to the bottom of the revolving vessel 32*a*** so as to flow upwardly therethrough.

Figure 18:
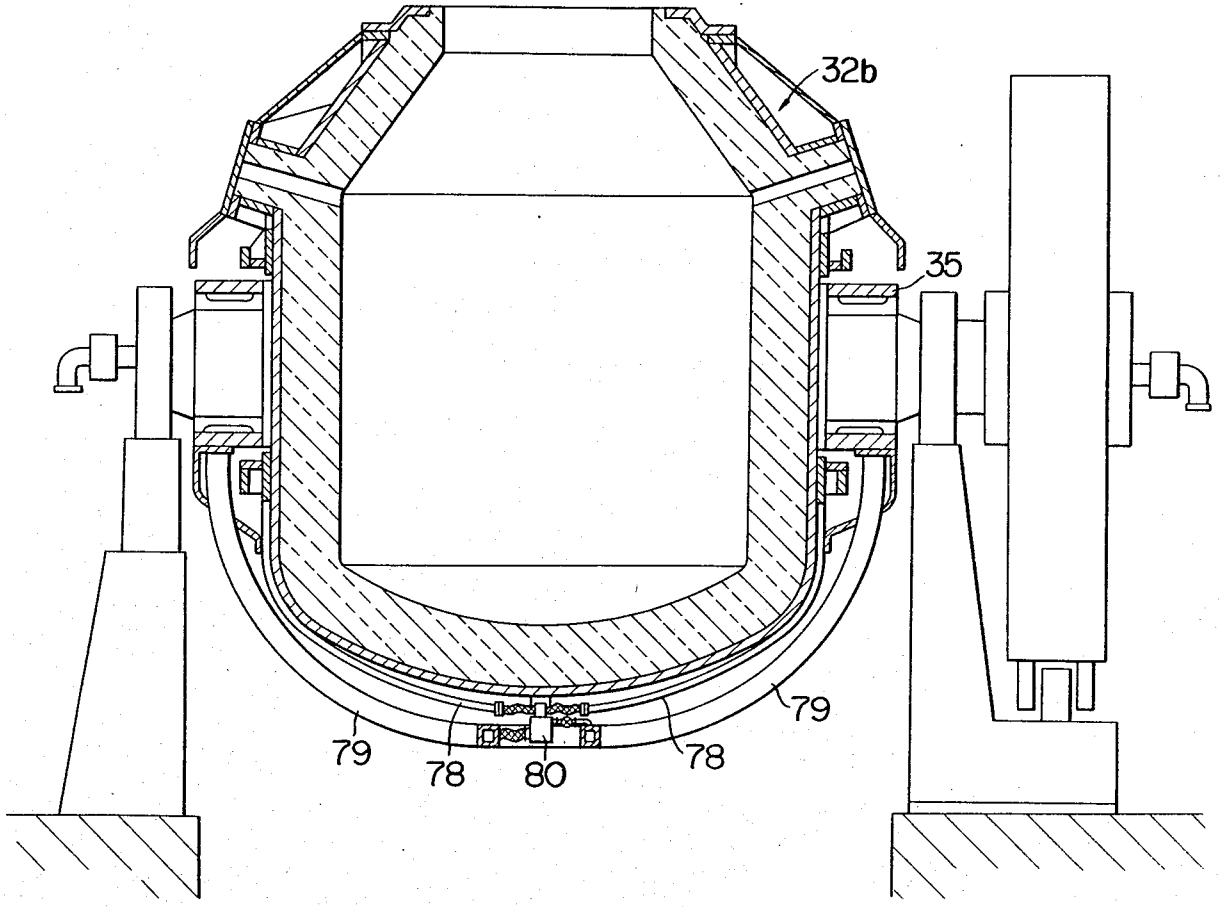
FIG. 18 is an axial sectional view of another bottom-blown converter embodying the invention, the converter being additionally equipped with vessel-cooling means.

FIG. 18 shows another example of a bottom-blown converter in accordance with this invention. This converter has two conduits 78 and two other conduits 79 depending from the trunnion ring 35 and coupled to the bottom of a converter vessel **32*b* via a rotary joint 80. The two additional conduits are for the delivery of a cooling medium, such as water, air or steam, into the vessel 32*b*** for cooling the same.

Figure 19:
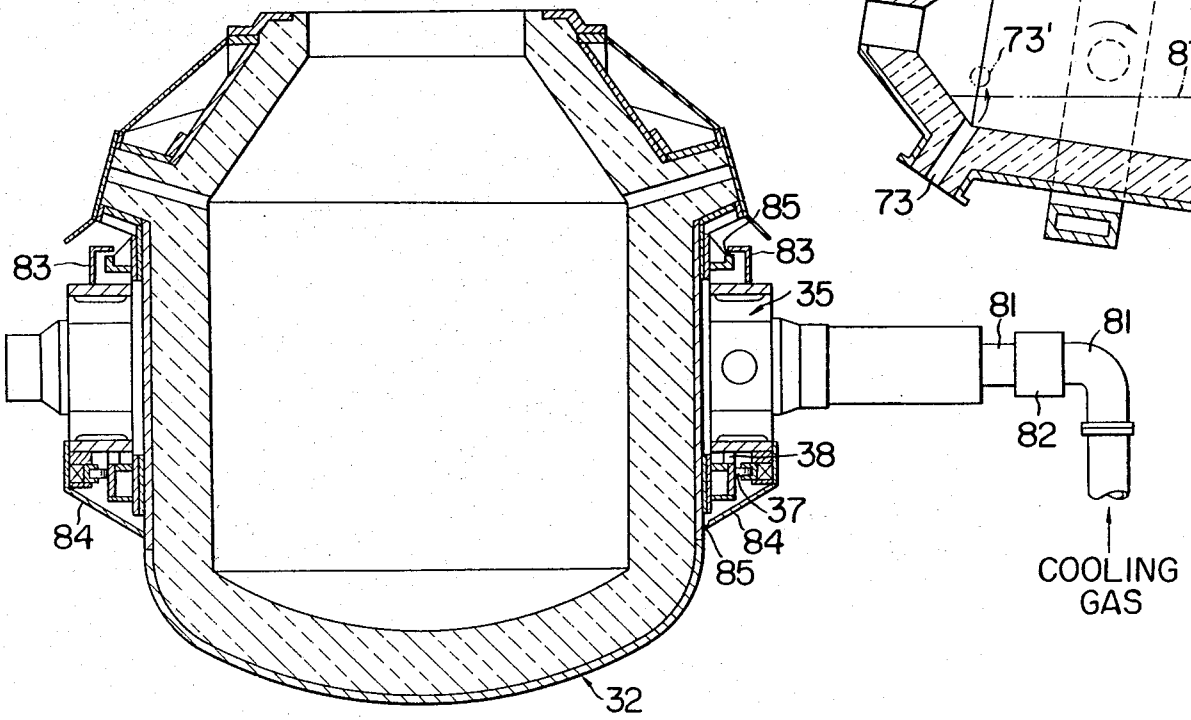
FIG. 19 is an axial sectional view of a further preferred embodiment of the invention.

FIG. 19 shows a further preferred embodiment of the invention, which may be considered a modification or refinement of the converter shown in FIGS. 3 through 6. The modified rotary converter of FIG. 19 includes a conduit system 81 having a rotary joint 82 and extending through one of the trunnions. The conduit system 81 delivers a cooling medium, preferably gaseous, to the trunnion ring 35 for cooling the same.

The converter of FIG. 19 also features two annular shields 83 and 84 attached to the trunnion ring 35 so as to enclose the two rows of radial rollers 37, two rows of thrust rollers 38, and their support mechanisms. Annular gaps 85 exist between the vessel 32 and the shields 83 and 84.

In the use of the converter shown in FIG. 19 the gaseous cooling medium that has cooled the trunnion ring 35 is discharged into the space between vessel 32 and trunnion ring 35. The discharged cooling medium cools the vessel 32 and then escapes into the atmosphere through the gaps 85 between the vessel and the shields 83 and 84, thereby serving to prevent dust intrusion into the shields. Thus the gaseous cooling medium serves the triple purpose of cooling the trunnion ring 35, cooling the vessel 32, and protecting the radial rollers 37 and thrust rollers 38 from dust.

The rotary converter in accordance with the invention permits the following three typical steelmaking methods.

1. With its axis Y—Y oriented vertically, the vessel 32, 32*a* or 32*b* is revolved either continuously or intermittently, and either in one or two opposite directions, at a speed of, for example, one to 30 revolutions per minute (rpm). The molten pig iron, scrap and various admixtures within the vessel are thus stirred and intermingled. Simultaneously, oxygen is introduced into the revolving vessel, either through an oxygen lance or through bottom tuyeres, for intimate contact with the molten charge materials being agitated as above, thereby providing the necessary refining reactions.

2. The vessel is tilted from 0° to about 15° from the perpendicular or oscillated in that range of angles. Simultaneously, as in the first described method, the vessel is revolved continuously or intermittently, and in one or two opposite directions, at a speed of one to 30 rpm. Oxygen is also blown into the vessel through an oxygen lance or through bottom tuyeres, for intimate contact with the melt being agitated by the revolving, and tilted or oscillating, vessel.

Figure 20:
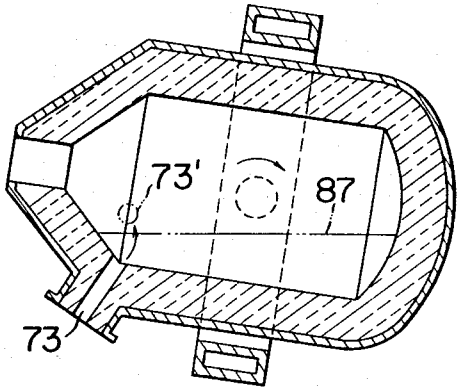
FIG. 20 is a schematic axial sectional view useful in explaining the operation of the rotary converter in accordance with the invention.

3. **L After tapping by either of the foregoing two methods, and concurrently with the return of the vessel from its pouring to upright position, the vessel is revolved about its own axis, as quickly as possible, through such an angle that the acting discharge port 73 is turned from its solid-line position shown in FIG. 20 to a phantom position indicated at 73*a*.** This phantom position is higher than the level 87 of the slag left in the vessel. It is thus possible to minimize the amount of the slag discharged with the steel.

The first two steelmaking methods afford efficient stirring, intermixing, and contacting with the oxygen, of the molten pig iron, scrap, and admixtures. This results in higher desulfurizing and dephosphorizing performance and greater refining efficiency of the converter. These methods apply also to refining operations with the use of argon, nitrogen, etc., instead of oxygen.

The third method reduces the amount of the slag that is admitted into a ladle following the discharge of the manufactured steel and so lessens the consumption of the refractory lining of the ladle. A higher alloy-iron yield is also realized.

In addition to these steelmaking methods the rotary converter in accordance with the invention makes possible the exploitation of several refractory repair methods without the noted problems of the prior art. One of these methods employs a high magnesia-content slag. If, in a converter having a basic refractory lining composed principally of magnesia, dolomite or the like, the magnesia concentration of the slag is made higher than a certain specifiable limit, the magnesia will deposit from the slag onto the refractory lining thereby making up for its consumption. A description of the refractory repair method utilizing such magnesia deposition follows.

Upon completion of a refining operation, in which magnesia has been added to the slag in excess of its saturation limit, the produced steel is poured out of the vessel 32, 32*a* or 32*b* with the slag left therein. The vessel is then revolved about its own axis Y—Y to such an angular position that a particularly worn lining region, if any, will be covered by the slag when the vessel is tilted susequently. Then the vessel is tilted or oscillated through a required angle about the trunnion axis X—X while being revolved about its own axis Y—Y in two opposite directions, through an angle of more than 90° (e.g., 100° ) in each direction. The worn lining area is thus coated concentratedly by the slag.

As has been pointed out, the refractory repair method by the coating of a high magnesia-content slag has been known and widely practiced. Its effectiveness is also an admitted fact. In order to derive full benefits from the slag-coating method, however, the vessel must be both tiltable and revolvable. The rotary converter in accordance with the invention permits the high magnesia-content slag to be coated anywhere on its refractory lining, as has been explained in the preceding paragraph. From the admitted effectiveness of the slag-coating method it is clear that, repaired in the above described manner, the refractory lining will enjoy a substantially semipermanent life.

According to another refractory repair method taking advantage of the rotary converter of this invention, a suitable amount of a high magnesia-content refractory of fluid form, containing raw or burned dolomite or the like, is charged into the vessel following the discharge of the steel and slag therefrom. The fluid refractory is then coated on the existing refractory lining by revolving the vessel about its own axis Y—Y and by tilting or oscillating same about the trunnion axis X—X.

Still another refractory repair method employs a powdered, high magnesia-content refractory and heat-generating material such as coke. After the manufactured steel and the slag have both been poured out of the vessel, the refractory and coke or the like are introduced into same. Oxygen is then blown through a lance to the introduced materials thereby combusting the coke and so melting the high magnesia-content refractory. The molten refractory can be coated on the refractory lining as the vessel is both revolved and tilted or oscillated.

A further similar method dictates the introduction of only a powdered high magnesia-content refractory into the vessel following the discharge of the manufactured steel and the slag therefrom. The refractory charge is heated and melted by means of a burner lance (i.e., an oxygen lance carrying a burner at its tip). The vessel is then both revolved and tilted or oscillated for coating the molten refractory on the refractory lining.

In the practice of the above described four refractory repair methods, the high magnesia-content refractory and other materials may be chuted, by remote control, from an overhead bunker into the vessel disposed uprightly. Alternatively, with the vessel tilted nearly horizontally, the materials may be introduced from a suitable charging machine on the floor into the vessel through its charge mouth. The particular layout of the converter equipment will determine the choice.

The rotary converter in accordance with the invention further enables efficient repair of the refractory lining by the known spray method. A pulverized refractory, either wet or dry, is sprayed by a special floor-mounted sprayer on consumed areas of the refractory lining, with the vessel disposed approximately horizontally or with one of the consumed areas facing substantially upward. The efficiency with which the refractory lining is repaired in this manner depends greatly upon the relative dispositions of the spray nozzle and the lining area being repaired. The efficiency is highest when the spray nozzle overlies the lining area being repaired. Since the invention permits free rotation of the converter vessel about its own axis, in addition to tilting about the trunnion axis, the pulverized refractory can be sprayed anywhere on its refractory lining from the overlying spray nozzle with the highest efficiency.

Permitting the thorough repair of its refractory lining as described above, the rotary converter in accordance with the invention gives rise to certain additional advantages absent from, for xample, the L-D converter. The refractory lining of the L-D converter is as thick as 600 to 1000 millimeters (mm). in a 100-ton/charge L-D converter, for example, the ratio of its shell capacity to its refractory-lined vessel capacity is initially about two but decreases to about 1.4 toward the end of the vessel life when its refractory consumption reaches a maximum.

Such excessive refractory consumption affects, of course, the level and surface area of the bath in the vessel, which are both important factors of the refining operation, particularly in connection with the stream of oxygen from the lance. Further, with the process of such refractory consumption, corresponding changes occur in the intravessel space necessary for the prevention of bath slopping and in the distance of the lance tip from the bath surface. Still further, the undue refractory wear can lead to a miscalculation of the volume of oxygen blown into the vessel for the manufacture of steel of a certain expected composition and, ultimately, to a decrease in the productivity of the converter.

The improved rotary converter of this invention allows easy forestallment of such excessive refractory consumption. Thus the initial thickness of its refractory lining can be only about 300 mm, which is an absolute minimum for proper heat insulation. This minimum thickness of the refractory lining remains substantially unaltered throughout the lifetime of the converter, resulting in the avoidance of the foregoing difficulties encountered heretofore.

The refractory lining of such minimum thickness also makes possible drastic reduction of the ratio of the shell capacity to the refractory-lined vessel capacity of the improved rotary converter. The ratio is as small as 1.5 in a 100-ton/charge version of the rotary converter. The shell capacity of this 100-ton/charge rotary converter is only about 75% of that of an L-D converter of the same class. Thus, for a given charge capacity, the external size of the improved rotary converter is far smaller than that of the L-D converter. The improved rotary converter with a charge capacity of 100 tons, for example, is equal in external size to the L-D converter with a charge capacity of only 60 tons.

It will of course be understood that changes may be made in the forms, details, arrangements, and proportions of the parts of the various illustrated rotary converters without departing from the scope of this invention.

What is claimed is:

1. A method of applying a refractory lining to an inner surface of a vessel of a steelmaking converter, comprising the steps of:

(a) providing the vessel with a trunnion ring encircling and supporting the vessel coaxially by radial and axial support rollers uniformly distributed substantially throughout the circumference of the trunnion ring, in such a manner as to enable the vessel to rotate about its centerline axis relative to the trunnion ring, which is rotatably supported about a stationary axis transverse to the centerline axis;

(b) providing a flowable refractory material within the vessel;

(c) rotating the vessel at least about its centerline axis to such an angular position that a specific worn lining region will be covered by the refractory material; and (d) causing the vessel to oscillate rotatingly through an angle about its centerline axis in two opposite directions with respect to said angular position.

2. The method of applying a refractory lining as claimed in claim 1, including the step of pouring produced steel out of the vessel with slag left therein, upon completion of a refining operation in the vessel, thereby to provide flowable refractory material in the vessel.

3. The method of applying a refractory lining as claimed in claim 2, including the step of adding magnesia to the slag in excess of its saturation limit when the refining operation is carried out.

4. The method of applying a refractory lining as claimed in claim 1, including the step of oscillating said vessel at an angle of more than 90 degrees in each of the opposite directions.

5. The method of applying a refractory lining as claimed in claim 1, including the steps of discharging produced steel and slag from the vessel upon completion of a refining operation in the vessel and then supplying into the vessel an amount of a high magnesia-content refractory material in fluid form, containing dolomite.

6. The method of applying a refractory lining as claimed in claim 1, including the steps of discharging produced steel and slag from the vessel upon completion of a refining operation in the vessel, then supplying into the vessel a powdered, high magnesia-content refractory material and a heat generating material, and thereafter blowing oxygen to these materials thereby causing the heat generating material to generate heat and to melt the refractory material.

7. The method of applying a refractory lining as claimed in claim 6, wherein the heat generating material is coke.

8. The method of applying a refractory lining as claimed in claim 1, including the steps of discharging produced steel and slag from the vessel upon completion of a refining operation in the vessel, then supplying a powdered, high magnesia-content refractory material into the vessel, and thereafter heating and melting the refractory material by means of a burner lance.

9. A method of applying a refractory lining to an inner surface of a vessel of a steelmaking converter, comprising the steps of:

(a) providing the vessel with a trunnion ring encircling and supporting the vessel coaxially by radial and axial support rollers uniformly distributed substantially throughout the circumference of the trunnion ring in such a manner as to enable the vessel to rotate about its centerline axis relative to the trunnion ring, which is rotatably supported about a stationary axis transverse to the centerline axis;

(b) rotating the vessel at least about its centerline axis to an angular position sufficient to cause a desired area on an inner surface of the vessel to face substantially upward; and (c) spraying a pulverized refractory material to the desired area substantially from above.

* * * * *